United States Patent [19]

Reneault et al.

[11] 4,434,592

[45] * Mar. 6, 1984

[54] HEAT AND SOUND INSULATING STRUCTURE FOR BOARDING OR OTHER NON-LOADBEARING WALL

[75] Inventors: Patrick Reneault, Garches; Francis Ovaert, Paris, both of France

[73] Assignee: SMAC Acieroid, Paris, France

[ * ] Notice: The portion of the term of this patent subsequent to Oct. 21, 1997 has been disclaimed.

[21] Appl. No.: 215,923

[22] Filed: Dec. 12, 1980

[30] Foreign Application Priority Data

Dec. 24, 1979 [FR] France ..... 79 31583

[51] Int. Cl.[3] ..... E04B 1/82

[52] U.S. Cl. ..... 52/145; 52/795; 52/809; 52/408; 181/290; 181/192

[58] Field of Search ..... 52/145, 144, 795, 796, 52/797, 798, 406, 479, 408, 809; 181/284, 290, 291, 292

[56] References Cited

U.S. PATENT DOCUMENTS

| | | | |
|---|---|---|---|
| 2,050,074 | 8/1936 | Trytten | 52/798 |
| 2,196,781 | 4/1940 | Saino | 52/796 |
| 3,031,044 | 4/1962 | Stitt | 52/795 |
| 3,343,314 | 9/1967 | Smith | 52/406 |
| 3,377,760 | 4/1968 | Waite | 52/795 |
| 3,474,583 | 10/1969 | Manias | 52/795 |
| 4,228,624 | 10/1980 | Reneault | 52/145 |

FOREIGN PATENT DOCUMENTS

| | | | |
|---|---|---|---|
| 873569 | 1/1979 | Belgium . | |
| 2323365 | 11/1973 | Fed. Rep. of Germany | 52/479 |
| 592791 | 11/1977 | Switzerland | 52/798 |

OTHER PUBLICATIONS

Belgium Abstract 873,569, Jan. 18, 1979.

*Primary Examiner*—Henry E. Raduazo

*Attorney, Agent, or Firm*—Wenderoth, Lind & Ponack

[57] ABSTRACT

The structure comprises a heat insulating panel maintained between an inner metal revetment and an outer metal revetment. The revetments are provided with ribs which project into the panel and the ribs of the two revetments are perpendicular to one another. A thin core of insulating material is applied against one of the revetments by a thin and solid metal sheet.

9 Claims, 3 Drawing Figures

HEAT AND SOUND INSULATING STRUCTURE FOR BOARDING OR OTHER NON-LOADBEARING WALL

DESCRIPTION

Many types of constructional elements or structures for heat and sound insulation exist at the present time. Unfortunately, the standards of comfort and the increasing volume of the sounds are such that these elements do not suitably satisfy the needs.

An improvement in their effectiveness is particularly difficult to achieve when they are intended for boarding or other non-loading bearing walls which must be very light and thin. Indeed, the two main factors in the reduction of noise are the mass per volume of the structure and, consequently, the density and the thickness of the various components, and the distance between successive components.

Further, the conditions of the absorption of interior noise are usually little compatible with an effective reduction in the transmission of exterior or aerial noise.

For example, a known insulating structure comprising a heat insulator maintained between two metal revetments insufficiently deadens the interior noise if the inner revetment is not perforated. However, this perforation reduces the reduction of the exterior noise.

A considerable improvement in the insulation is achieved in giving the inner revetment the shape of a closed structure containing a high-density insulator, but this improvement is limited by the requirements of lightness and small overall size when it concerns boarding or the like.

Consequently, an object of the present invention is to solve this problem by improving the insulating qualities of known structures without markedly increasing their weight or thickness.

According to the invention, there is provided a heat and sound insulating structure for boarding or other nonloadbearing wall, comprising a heat insulating panel maintained between an inner metal revetment and an outer metal revetment, said revetments being provided with ribs projecting in the panel, the ribs of the two revetments being perpendicular to each other, said structure further comprising a thin core of insulating material applied by a solid and thin metal sheet against one of the revetments.

Preferably, the thin core has an elastic laminated structure having high resistance to the passage of air.

The metal sheet is thin and is fixed to the core only by the fact that it is fixed to the revetment, i.e. in the region of the ribs, the core being merely pinched at these points so that there is no risk of this core being subjected to shear stress.

It is then found that, notwithstanding the small mass of the core and of the sheet, the reduction in the sound is distinctly improved, about all at low frequencies. The frequency of resonance of the structure is indeed considerably lowered.

It must be understood that the core and the sheet may be disposed on the outer revetment, in which case the sheet has ribs similar to those of the outer revetment which fit in the ribs of the latter or may be mounted on the inner revetment between the latter and the heat insulator.

The ensuing description of embodiments of the invention, given merely by way of examples and shown in the accompanying drawings, will bring out the advantages and features of the invention.

Figure 1:
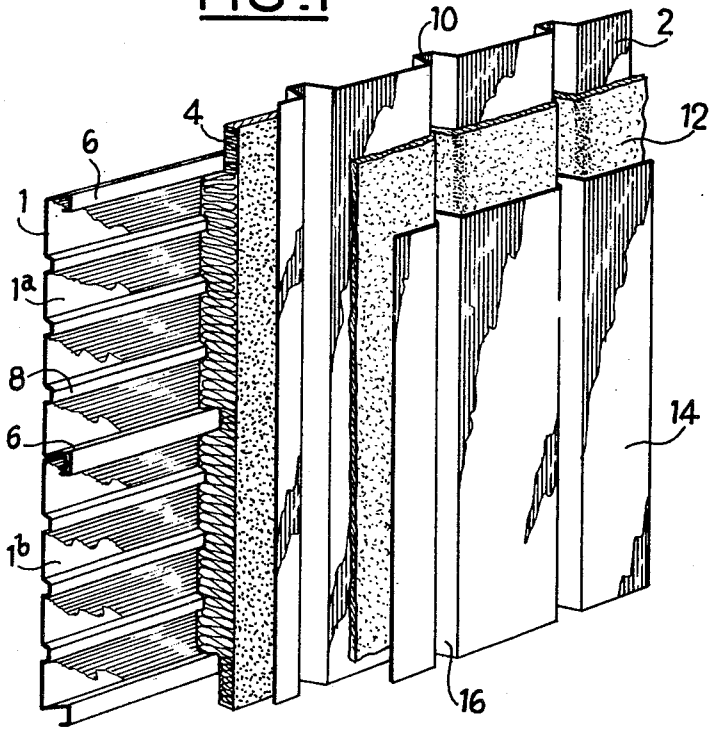
FIG. 1 is a diagrammatic perspective view with parts cut away of a portion of an insulating structure according to the invention.

As shown in FIG. 1, the insulating structure comprises an inner revetment 1 and an outer revetment or pan 2 between which there is maintained a panel 4 of heat insulating material.

In the illustrated embodiment, the inner revetment or sheet structure 1 is formed by a series of U-section trays fitted together in adjacent relationship to each other. The lateral flanges 6 of each of the trays 1*a*, 1*b* are folded at their free end all in the same direction so as to be able to hook onto the flanges of the adjacent tray. Further, the bottom of each tray is provided with ribs 8 which are parallel to the flanges 6 and project in the same direction.

These ribs 8 and the flanges 6 ensure the maintenance of the insulating panel 4 which is preferably in one piece and fits on the succession of trays 1*a*, 1*b* etc.

On the opposite side of the panel 4, the outer pan 2 is formed by a relatively thin sheet provided with ribs 10 projecting toward the panel 4 and in contact with the latter but perpendicular to the ribs 8 and the flanges 6 of the revetment or sheets 1. The inner and outer revetments 1 and 2 are locally fixed to each other at the crossing points of the ribs 10 and flanges 6 so as to assemble the structure.

According to the invention, the insulating structure further comprises a thin core 12 which covers the outer surface of the revetment 2 and has a shape conforming to the shape of said outer surface, i.e. penetrates the ribs 10.

The core 12 is preferably made from a web of fiber glass having a laminated structure, i.e. having a plurality of layers, so as to have high resistance to air. This core 12 is covered with a thin sheet 14 of steel or like metal provided with ribs 16 similar to the ribs 10 of the pan 2 and fitting in the ribs 10. The core 12 is thus pinched between the ribs 10 and 16 and maintained in contact with the pan 2 and the sheet 14 with no necessity of any fixing means for this purpose. The core 12, the revetment 2 and the sheet are in adjoining relation to one another in a sandwich assembly, as shown.

The means fixing the sheet 14 and the sheet of the pan 2, and extending through these sheets in the region of the flanges 6 of the revetment 1, are sufficient to maintain the core 12 suitably in position.

Moreover, the absence of adhesion or other means for rendering the core 12 rigid with the sheet 14 or 2, avoids any risk of subjecting this core to shear stress liable to result in deformations or act on the frequency of resonance of the assembly.

The web has a very small thickness, of the order of 2 to 4 mm, and preferably 2 mm. Likewise, the sheet 14 is preferably a sheet of 1 mm thick. Consequently, the outer pan 2 combined with the core 12 and the sheet 14, constitutes a very thin double wall on the outer side of the insulating structure.

However, it is found that this double wall markedly enhances the performances of the structure and in particular the sound reduction obtained by means of this wall. This reduction is particularly noticeable at low frequencies, since the frequency of resonance of the structure is lowered below 100 hz, i.e. practically below the usual frequencies of resonance for double metal walls (100 to 315 hz).

Such a structure thus affords an effective protection against aerial noise with a small thickness and increase in weight with respect to those of known structures.

Figure 2:
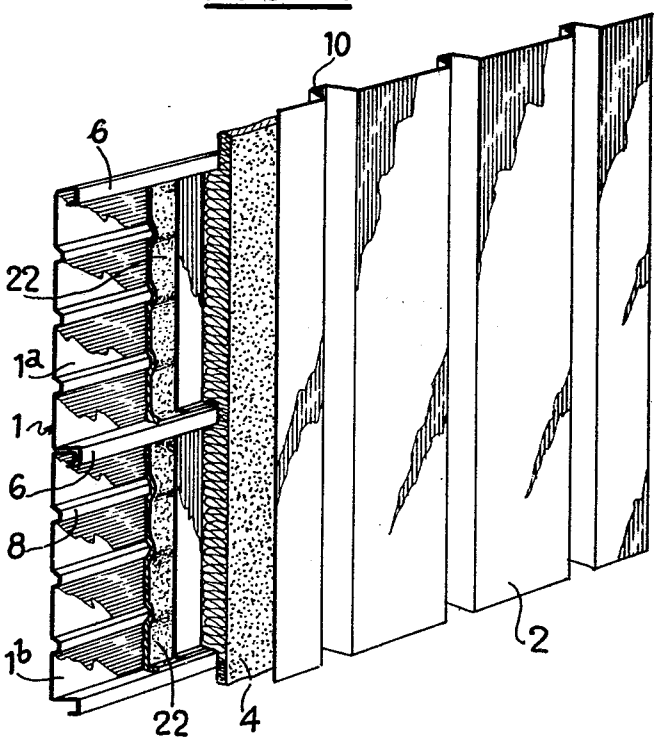
FIGS. 2 and 3 are views similar to FIG. 1 of modifications of the insulating structure.

The increase in the thickness may moreover be still further reduced, and even eliminated, if the insulating structure is made in the way shown in FIG. 2.

Indeed, in this embodiment, a thin core 22 is mounted against the revetment or sheet 1 between the latter and a thin sheet 24. The thin core 22 is then applied against the ribs 8 of each of the trays 1*a*, 1*b* and bent at its ends against the flanges 6 of this tray.

In the same way, the sheet 24 bent at its two ends, is fitted in each tray 1*a*, 1*b* and fixed to the flanges 6 of this tray. The panel 4 which is of mineral wool felt or any other heat insulator, is in contact with the successive sheets 24 on each side of the connecting flanges 6 between the different trays. This panel may have the same thickness as that employed in the embodiment of FIG. 1 or have a slightly smaller thickness so as to impart to the assembly of the structure a smaller thickness corresponding to that of the structure devoid of the fiber glass web and sheet 14, the outer revetment 2 being constructed in the same way by means of a thin metal sheet provided with ribs 10.

In this case, as in the foregoing embodiment, the web 22 is simply pinched between the sheet 24 and the ribs 8 of the revetment aganst which it is placed. No particular adhering or fixing means is required.

Such a structure also satisfies the requirements of lightness of the boardings or other claddings of buildings and in particular industrial buildings.

Figure 3:
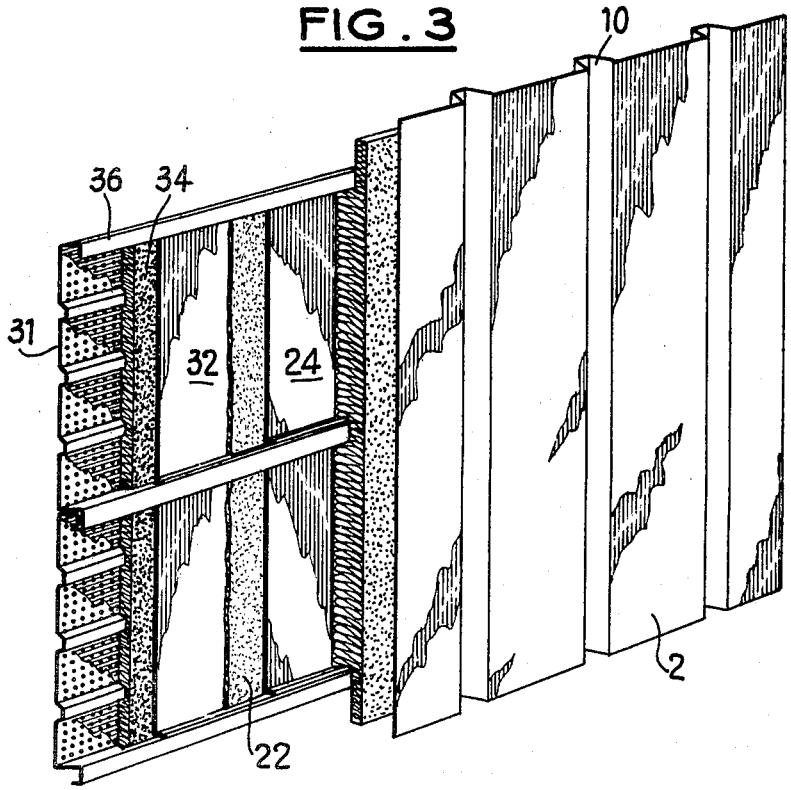

When the deadening of the interior noise is an important parameter of the boarding design, it might be found of utility to perforate the inner revetment or sheet, and in this case this revetment is preferably made in the form of box structures as shown in FIG. 3.

Each box structure of this inner revetment comprises consequently a perforated U-section tray 31 having flanges 36 between which flanges there is fitted a solid sheet 32 which maintains a thin panel of high-density mineral wool 34 which fills the space between the solid sheet 32 and the perforated tray 31. The thin core 22 is then mounted against the sheet 32 which closes the box structure and the sheet 24 maintains this core 22 between the flanges 36 of the tray. As in the foregoing embodiments, a panel of mineral wool felt 4 or the like overlies the ribs formed by the flanges 36 of the successive trays and is protected by an outer pan 2 whlich has ribs 10 perpendicular to these flanges 36.

The structure constructed in this way affords a real deadening of the interior noise owing to the perforation of the inner plate 31, but has a high sound reducing index owing to the combination of the walls 32 and 24 with the thin core 22 which is added to the action of the outer pan 2 and of the insulator 4. This structure, whose thickness may be very close to that of the embodiment of FIG. 2, has a very low frequency of resonance which no longer hinders the sound reduction and permits the obtainment of a sound reduction curve which rises in an almost regular manner as a function of the frequency from frequencies lower than 100 hz.

This structure, all the elements of which are light and relatively thin, is particularly adapted to the construction of claddings or boardings of buildings or other non-load bearing walls, intended to be placed on elements of metal or concrete. The tray 1 (FIGS. 1 and 2) or the box structure 31 (FIG. 3), are mechanically fixed to the supporting framework by any suitable means. A flexible sealing element (of the flexible cellular PVC or Neoprene type) may be interposed between the support structure and the tray or box structure so as to reduce the transmission of vibrations from the framework to the wall. The air sealing and therefore the sound insulation of the wall are also enhanced by placing an adhesive flexible sealing element on the flange 6 of the tray 1 or 36 of the tray 31. This sealing element is pinched when mounting between the various trays which fit into each other in succession. The performances obtained are in the neighbourhood of those of a sheet of concrete of several hundreds of $kg/m^2$.

Having now described our invention what we claim as new and desire to secure by Letters Patent is:

1. A heat and sound insulating structure for boarding or other non-loadbearing wall of a premises, comprising in combination an inner first metal sheet for facing toward the interior of said premises and a second metal sheet, a heat insulating panel, said sheets having ribs projecting into the panel and intermediate portions between the ribs, the ribs of the first and second sheets being perpendicular to one another, a substantially 2–4 mm thick core of sound insulating material and a solid and thin third metal sheet, one of said second and third metal sheets being an interposed metal sheet interposed between the core and the heat insulating panel, the heat insulating panel, the core and the interposed metal sheet being in adjoining relation to one another in a sandwich assembly, the heat insulating panel being in adjoining relation to one of said first and second metal sheets, the first and second metal sheets, the core, the third sheet and the heat insulating panel being held assembled, the heat insulating panel substantially filling any space between the interposed metal sheet and the adjoining one of the first and second sheets, the intermediate portions of each of the first and second sheets having a given width and the ribs of each of the first and second sheets having a width and a depth which are each a minor fraction of the given width of the intermediate portions thereof, the core of sound insulating material being in fully adjoining relation to at least one of said metal sheets without empty spaces therebetween, and the heat insulating panel being in fully adjoining relation to at least one of said metal sheets without empty spaces therebetween.

2. A structure according to claim 1, wherein the core has an elastic laminated structure having a good resistance to the passage of air.

3. A structure according to claim 1, characterized in that the core is a web of fiber glass.

4. A structure according to claim 2, characterized in that the core is a web of fiber glass.

5. A structure according to claim 1 or 2, wherein the core covers the second metal sheet and is covered by said thin third metal sheet, the core and thin third metal sheet having ribs matching the ribs of the second metal sheet so that the second metal sheet, core and thin third metal sheet are completely in adjoining relation to one another.

6. A structure according to claim 3, wherein the core covers the second metal sheet and is covered by said thin third metal sheet, the core and thin third sheet having ribs matching the ribs of the second metal sheet so that the second metal sheet, core and thin third metal sheet are completely in adjoining relation to one another.

7. A structure according to claim 1, 2 or 4, wherein the core and the thin third metal sheet are placed between the inner first metal sheet and the heat insulating panel.

8. A structure according to claim 7, wherein the inner first mental sheet has a U-section defining flanges and the core and thin metal sheet are bent at ends thereof and fixed to the flanges defined by the U-section.

9. A structure according to claim 1, 2, 3 or 4, wherein the inner first metal sheet is part of a closed box structure comprising a perforated U-section tray having two flanges, said first metal sheet closing the tray and a high-density insulating panel filling the box structure, and the core and the thin third metal sheet are mounted on said box structure between the flanges of the tray and the heat insulating panel.

* * * * *